US009798281B2

(12) United States Patent
Hirai

(10) Patent No.: US 9,798,281 B2
(45) Date of Patent: Oct. 24, 2017

(54) IMAGE FORMING APPARATUS, IMAGE FORMING SYSTEM AND CONTROL METHOD

(71) Applicant: Konica Minolta, Inc., Chiyoda-ku, Tokyo (JP)

(72) Inventor: Atsuto Hirai, Nara (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/223,017

(22) Filed: Jul. 29, 2016

(65) Prior Publication Data

US 2017/0038720 A1 Feb. 9, 2017

(30) Foreign Application Priority Data

Aug. 7, 2015 (JP) ..... 2015-157005

(51) Int. Cl.

| | |
|---|---|
| ***G03G 15/00*** | (2006.01) |
| ***G03G 21/00*** | (2006.01) |
| ***G03G 9/097*** | (2006.01) |

(52) U.S. Cl.

CPC ..... *G03G 15/5058* (2013.01); *G03G 9/09791* (2013.01); *G03G 21/0094* (2013.01)

(58) Field of Classification Search

CPC ..... G03G 15/5058; G03G 9/09791; G03G 21/0094; G03G 9/0819; G03G 15/065; G03G 15/08; G03G 2215/00569

See application file for complete search history.

(56) References Cited

U.S. PATENT DOCUMENTS

| | | | | |
|---|---|---|---|---|
| 2008/0226320 | A1* | 9/2008 | Sakata | G03G 15/065 399/55 |
| 2010/0316401 | A1* | 12/2010 | Gomi | G03G 15/065 399/49 |
| 2011/0268463 | A1 | 11/2011 | Kimura et al. | |
| 2014/0334836 | A1* | 11/2014 | Yoshiyama | G03G 15/065 399/53 |

FOREIGN PATENT DOCUMENTS

| | | | |
|---|---|---|---|
| JP | 3066534 | B2 | 7/2000 |
| JP | 2000-338733 | A | 12/2000 |
| JP | 2004-264428 | A | 9/2004 |
| JP | 2014-145864 | | 8/2014 |
| JP | 2014219645 | A | 11/2014 |
| JP | 2014224844 | A | 12/2014 |

OTHER PUBLICATIONS

Etended European Search Report dated Dec. 8, 2016 issued in corresponding European Patent Appln. No. 16182178.0 (10 pages).
Notice of Reasons of Rejection issued by the Japanese Patent Office dated Jun. 20, 2017 in corresponding Japanese Application No. 2015-157005 with English language translation (8 pages).

* cited by examiner

*Primary Examiner* — Clayton E Laballe
*Assistant Examiner* — Ruifeng Pu
(74) *Attorney, Agent, or Firm* — Buchanan Ingersoll & Rooney PC

(57) ABSTRACT

An image forming apparatus includes an image bearing member to which lubricant is supplied; a toner image forming section; and a patch image forming section and a control section configured to control the toner image forming section and the patch image forming section such that a first development condition for forming the patch image and a second development condition for forming the toner image are different from each other.

18 Claims, 12 Drawing Sheets

IMAGE FORMING APPARATUS, IMAGE FORMING SYSTEM AND CONTROL METHOD

CROSS REFERENCE TO RELATED APPLICATIONS

This application is entitled to and claims the benefit of Japanese Patent Application No. 2015-157005, filed on Aug. 7, 2015, the disclosure of which including the specification, drawings and abstract is incorporated herein by reference in its entirety.

BACKGROUND OF THE INVENTION

1. Field of the Invention

The present invention relates to an image forming apparatus, an image forming system and a control method.

2. Description of Related Art

In an image forming apparatus using an electrophotographic scheme, a cleaning device of a blade-cleaning type has been used in which a plate-shaped cleaning blade composed of an elastic body and serving as a device for removing remaining toner such as untransferred toner and transfer residual toner on an image bearing member is brought into contact with the surface of an image bearing member to remove the remaining toner on the image bearing member, for example.

In recent years, reduction of the particle size of the toner of image forming apparatuses of an electrophotographic scheme has been demanded from the view point of enhancing the image quality, and for such a purpose, polymerization methods such as the emulsion polymerization method and the suspension polymerization method have been utilized, for example. As the size of the toner particle decreases, however, the attaching force between the toner particle and the image bearing member increases, thus reducing the ease of removal of the remaining toner on the image bearing member. In particular, when a so-called polymerization toner produced by a polymerization method is used, the toner particles have a substantially spherical shape, and as a result cleaning failures in which the toner particles roll on the image bearing member and slip through the cleaning blade is easily caused, thus further reducing the ease of removal of the remaining toner on the image bearing member. In addition, when toner slips through the cleaning blade, the toner becomes the core of toner aggregate formed on the image bearing member, and grain blank (grain noise) is generated on the solid image printing part.

To solve such a quality problem as the "slipping" and "grain noise," today, lubricant-external additive (hereinafter referred to as "lubricant") is supplied onto the image bearing member such that cleaning is performed in the state where the attaching force between the toner particles and the image bearing member is reduced to a low level. Examples of the approach for supplying lubricant onto the image bearing member include a lubricant application process in which lubricant is scraped with a brush to supply the lubricant to the surface of the image bearing member; and a toner adding process in which a toner image is formed with toner containing lubricant to supply the lubricant.

The toner adding process does not require a coating device such as a lubricant rod and a brush and therefore is advantageous in terms of installation space and cost. In the toner adding process, however, the lubricant is preferentially consumed when an image having a low area rate is continuously printed, and as a result, the amount of the lubricant in the developing device decreases. When the amount of the lubricant in the developing device decreases, the amount of the lubricant supplied to the surface of image bearing member may decrease, and a region where no lubricant is supplied may be formed. Consequently, reduction of the adhesion to toner which is a purpose of supplying lubricant to the image bearing member cannot be achieved, and cleaning failure may occur.

In particular, for the purpose of preventing the abovementioned problems, a patch image (toner image) is formed in regions other than the image region on the image bearing member when an image having a low area rate is formed. By forming the patch image, lubricant is supplied onto the image bearing member, and the toner in the developing device is consumed, and as a result, new toner is supplied into the developing device. When the new toner is supplied, lubricant is also supplied, and thus the amount of the lubricant in the developing device can be prevented from being reduced, and in turn, the amount of the lubricant on the image bearing member can be prevented from being reduced.

For example, Japanese Patent Application Laid-Open No. 2014-145864 discloses a technique in which a patch image between images is formed based on the gradation information of the image, and lubricant is selectively supplied to the regions where cleaning failure may possibly occur.

However, the toner used for patch image formation for supplying lubricant to the image bearing member is discarded as it is without being transferred to sheets. Consequently, as a large number of patch images are formed, the consumption amount of the toner increases, and the cost for supplying lubricant onto the image bearing member disadvantageously increases.

SUMMARY OF THE INVENTION

An object of the present invention is to provide an image forming apparatus, an image forming system and a control method which can reduce the cost for supplying lubricant onto an image bearing member.

To achieve the abovementioned object an image forming apparatus reflecting one aspect of the present invention includes an image bearing member to which lubricant is supplied; a toner image forming section configured to form a toner image on the image bearing member; a patch image forming section configured to form a patch image different from the toner image on the image bearing member; and a control section configured to control the toner image forming section and the patch image forming section such that a first development condition for forming the patch image and a second development condition for forming the toner image are different from each other.

Desirably, in the image forming apparatus, the patch image forming section forms the patch image with use of toner mixed with the lubricant to supply the lubricant onto the image bearing member.

Desirably, the image forming apparatus further includes a lubricant application section configured to apply the lubricant onto the image bearing member to supply the lubricant onto the image bearing member.

Desirably, in the image forming apparatus, the patch image forming section forms the patch image after the toner image is formed by the toner image forming section.

Desirably, in the image forming apparatus, the patch image forming section forms the patch image before the toner image is formed by the toner image forming section.

Desirably, in the image forming apparatus, the patch image forming section forms the patch image in a patch image formation region different from a toner image formation region in which the toner image is formed on the image bearing member.

Desirably, in the image forming apparatus, when an area ratio of the toner image is smaller than a predetermined area ratio, the patch image forming section forms the patch image.

Desirably, in the image forming apparatus, the control section sets the first development condition and the second development condition different from each other by operating such that a first potential difference between a first developing bias and a first surface potential of the image bearing member in formation of the patch image is smaller than a second potential difference between a second developing bias and a second surface potential of the image bearing member in formation of the toner image.

Desirably, in the image forming apparatus, the control section sets the first developing bias and the second developing bias different from each other such that the first potential difference is smaller than the second potential difference.

Desirably, in the image forming apparatus, the control section sets the first surface potential and the second surface potential different from each other such that the first potential difference is smaller than the second potential difference.

Desirably, in the image forming apparatus, the lubricant has a particle size smaller than a particle size of the toner.

In addition, to achieve the abovementioned object an image forming system reflecting one aspect of the present invention is composed of a plurality of units including an image forming apparatus, the image forming system including: an image bearing member to which lubricant is supplied; a toner image forming section configured to form a toner image on the image bearing member; a patch image forming section configured to form a patch image different from the toner image on the image bearing member; and a control section configured to control the toner image forming section and the patch image forming section such that a first development condition for forming the patch image and a second development condition for forming the toner image are different from each other.

Desirably, in the image forming system, the patch image forming section foil is the patch image with use of toner mixed with the lubricant to supply the lubricant onto the image bearing member.

Desirably, the image forming system further includes a lubricant application section configured to apply the lubricant onto the image bearing member to supply the lubricant onto the image bearing member.

Desirably, in the image forming system, the patch image forming section forms the patch image after the toner image is fanned by the toner image forming section.

Desirably, in the image forming system, the patch image forming section forms the patch image before the toner image is formed by the toner image forming section.

Desirably, in the image forming system, the patch image forming section forms the patch image in a patch image formation region different from a toner image formation region in which the toner image is formed on the image bearing member.

Desirably, in the image forming system, when an area ratio of the toner image is smaller than a predetermined area ratio, the patch image forming section forms the patch image.

Desirably, in the image forming system, the control section sets the first development condition and the second development condition different from each other by operating such that a first potential difference between a first developing bias and a first surface potential of the image bearing member in formation of the patch image is smaller than a second potential difference between a second developing bias and a second surface potential of the image bearing member in formation of the toner image.

In addition, to achieve the abovementioned object, a controlling method reflecting one aspect of the present invention is used in an image forming apparatus, the image forming apparatus including: an image bearing member to which lubricant is supplied; a toner image forming section configured to form a toner image on the image bearing member; and a patch image forming section configured to form a patch image different from the toner image on the image bearing member. The toner image forming section and the patch image forming section are controlled such that a first development condition for forming the patch image and a second development condition for forming the toner image are different from each other.

DESCRIPTION OF THE PREFERRED EMBODIMENTS

Figure 1:
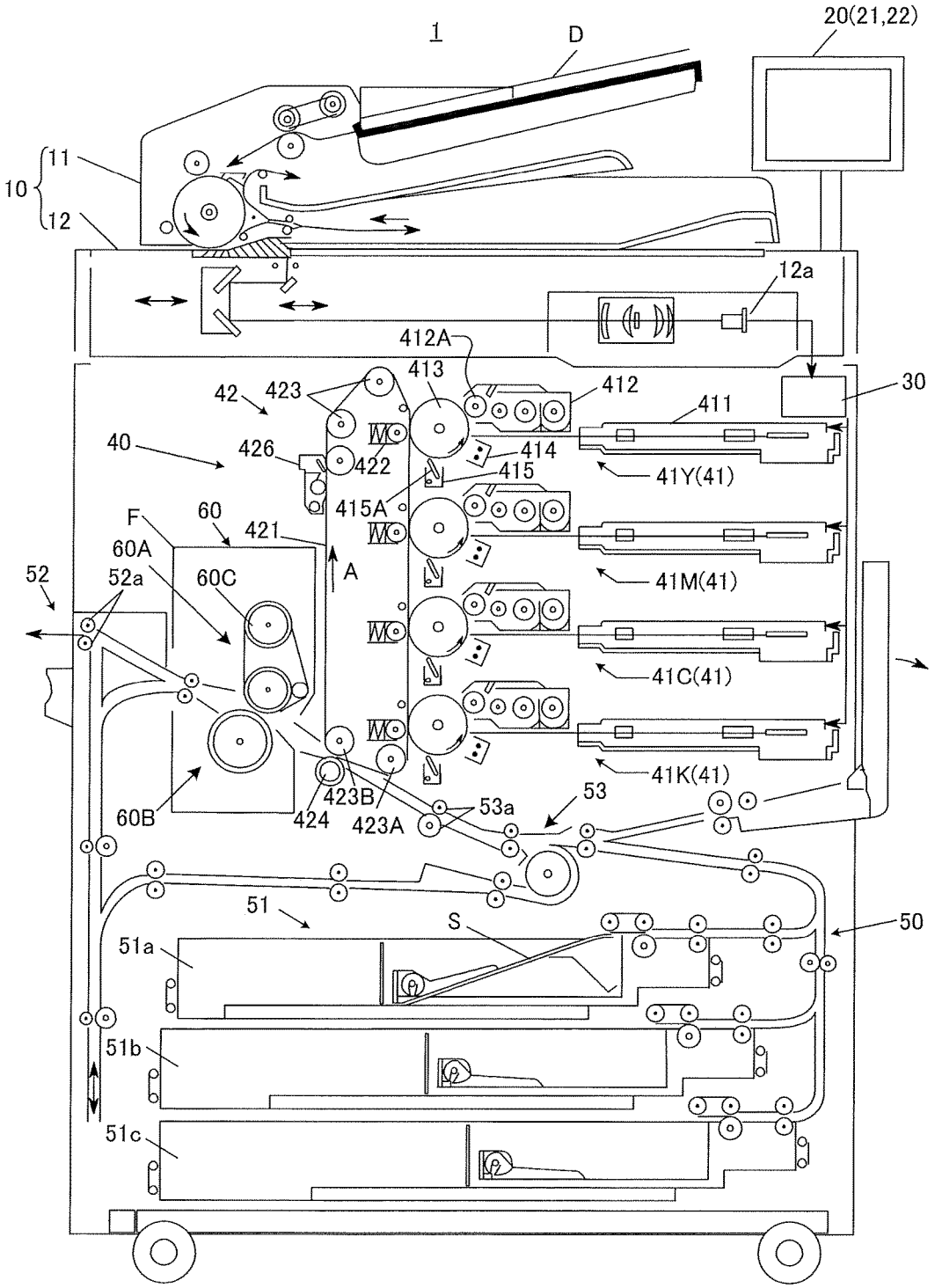
FIG. 1 schematically illustrates an entire configuration of an image forming apparatus of Embodiment 1.

In the following, Embodiment 1 of the present invention is described in detail with reference to the drawings. FIG. 1 illustrates an overall configuration of image forming apparatus 1 according to Embodiment 1 of the present invention.

Figure 2:
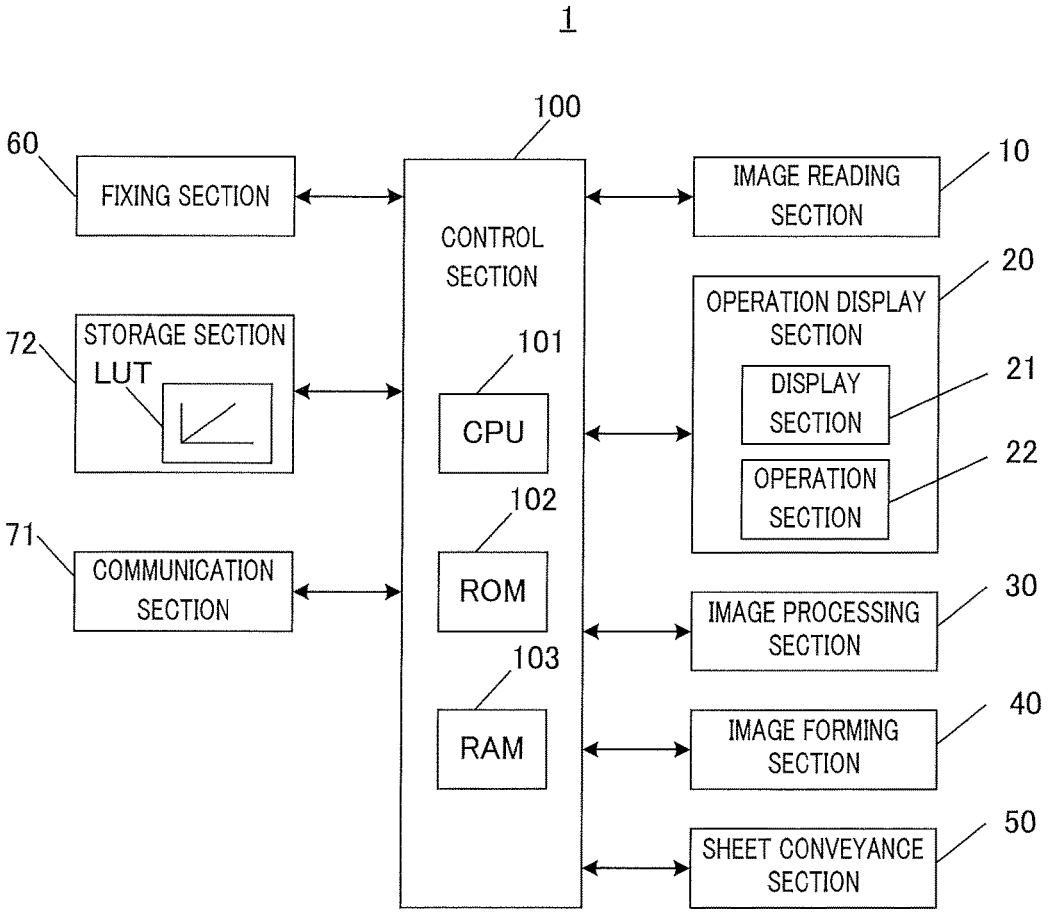
FIG. 2 illustrates a principal part of a control system of the image forming apparatus of Embodiment 1.

FIG. 2 illustrates a principal part of a control system of image forming apparatus 1 according to Embodiment 1. Image forming apparatus 1 illustrated in FIGS. 1 and 2 is a color image forming apparatus of an intermediate transfer system using electrophotographic process technology. That is, image forming apparatus 1 primary-transfers toner images of yellow (Y), magenta (M), cyan (C), and black (K) formed on photoconductor drums 413 as an example of an image bearing member to intermediate transfer belt 421, and superimposes the toner images of the four colors on one another on intermediate transfer belt 421. Then, image forming apparatus 1 transfers (secondary-transfers) the resultant image to sheet S, to thereby form an image.

A longitudinal tandem system is adopted for image forming apparatus 1. In the longitudinal tandem system, respective photoconductor drums 413 corresponding to the four colors of YMCK are placed in series in the travelling direction (vertical direction) of intermediate transfer belt 421, and the toner images of the four colors are sequentially transferred to intermediate transfer belt 421 in one cycle.

As illustrated in FIG. 2, image forming apparatus 1 includes image reading section 10, operation display section 20, image processing section 30, image forming section 40, sheet conveyance section 50, fixing section 60 and control section 100.

Control section 100 includes central processing unit (CPU) 101, read only memory (ROM) 102, random access memory (RAM) 103 and the like. CPU 101 reads a program suited to processing contents out of ROM 102, develops the program in RAM 103, and integrally controls an operation of each block of image forming apparatus 1 in cooperation with the developed program. At this time, CPU 101 refers to various kinds of data stored in storage section 72. Storage section 72 is composed of, for example, a non-volatile semiconductor memory (so-called flash memory) or a hard disk drive. In the present embodiment, storage section 72 stores image formation information relating to a printing job executed by image forming section 40. The image formation information includes information such as the number of prints and the area ratio of an input image, for example.

Control section 100 transmits and receives various data to and from an external apparatus (for example, a personal computer) connected to a communication network such as a local area network (LAN) or a wide area network (WAN), through communication section 71. Control section 100 receives, for example, image data transmitted from the external apparatus, and performs control to form an image on sheet S on the basis of the image data (input image data). Communication section 71 is composed of, for example, a communication control card such as a LAN card.

As illustrated in FIG. 1, image reading section 10 includes auto document feeder (ADF) 11, document image scanning device 12 (scanner), and the like.

Auto document feeder 11 causes a conveyance mechanism to feed document D placed on a document tray, and sends out document D to document image scanner 12. Auto document feeder 11 enables images (even both sides thereof) of a large number of documents D placed on the document tray to be successively read at once.

Document image scanner 12 optically scans a document fed from auto document feeder 11 to its contact glass or a document placed on its contact glass, and brings light reflected from the document into an image on the light receiving surface of charge coupled device (CCD) sensor 12a, to thereby read the document image. Image reading section 10 generates input image data on the basis of a reading result provided by document image scanner 12. Image processing section 30 performs predetermined image processing on the input image data.

As illustrated in FIG. 2, operation display section 20 includes, for example, a liquid crystal display (LCD) with a touch panel, and functions as display section 21 and operation section 22. Display section 21 displays various operation screens, image conditions, operating statuses of functions, and the like in accordance with display control signals received from control section 100. Operation section 22 includes various operation keys such as numeric keys and a start key, receives various input operations performed by a user, and outputs operation signals to control section 100.

Image processing section 30 includes a circuit that performs a digital image process suited to initial settings or user settings on the input image data, and the like. For example, image processing section 30 performs tone correction on the basis of tone correction data (tone correction table), under the control of control section 100. In addition to the tone correction, image processing section 30 also performs various correction processes such as color correction and shading correction as well as a compression process, on the input image data. Image forming section 40 is controlled on the basis of the image data that has been subjected to these processes.

As illustrated in FIG. 1, image foil ling section 40 includes: image forming units 41Y, 41M, 41C, and 41K that form images of colored toners of a Y component, an M component, a C component, and a K component on the basis of the input image data; intermediate transfer unit 42; and the like. Image forming section 40 corresponds to the toner image forming section and the patch image forming section of the embodiments of the present invention.

Image forming units 41Y 41M, 41C, and 41K for the Y component, the M component, the C component, and the K component have similar configurations. For ease of illustration and description, common elements are denoted by the same reference signs. Only when elements need to be discriminated from one another, Y, M, C, or K is added to their reference signs. In FIG. 1, reference signs are given to only the elements of image forming unit 41Y for the Y component, and reference signs are omitted for the elements of other image forming units 41M, 41C, and 41K.

Image forming unit 41 includes exposure device 411, developing device 412, photoconductor drum 413, charging device 414, drum cleaning device 415 and the like.

Photoconductor drum 413 is composed of an organic photoconductor in which a photosensitive layer made of a resin containing an organic photoconductive member is formed on the outer peripheral surface of a drum-like metal base, for example. Examples of the resin of the photosensitive layer include polycarbonate resin, silicone resin, polystyrene resin, acrylic resin, methacryl resin, epoxy resin, polyurethane resin, chloride vinyl resin, melamine resin and the like.

Control section 100 controls a driving current supplied to a driving motor (not shown in the drawings) that rotates photoconductor drums 413, whereby photoconductor drums 413 is rotated at a constant circumferential speed.

Charging device 414 is, for example, a charging charger and causes corona discharge to evenly negatively charge the surface of photoconductor drum 413 having photoconductivity.

Exposure device 411 is composed of, for example, a semiconductor laser, and configured to irradiate photoconductor drum 413 with laser light corresponding to the image of each color component. As a result, in the surface of photoconductor drum 413, an electrostatic latent image of each color component is formed in the image region irradiated with laser light by the potential difference from the background region.

Developing device 412 is a developing device of a two-component reverse type, and attaches developers of respective color components to the surface of photoconductor drums 413, and visualizes the electrostatic latent image to form a toner image.

It is to be noted that toner and carrier for charging the toner are mixed in the developer. In the present embodiment, the toner is negatively charged. In addition, the toner is not particularly limited, and it is possible to adopt toner in which colorant and, as necessary, charge control agent, releasing agent and the like are contained in binder resin, and lubricant is added. In addition, preferably, the toner has a particle size of about 3 to 15 [μm].

In addition, as the carrier, commonly used and publicly known carriers such as binder-type carriers and coating-type carriers, for example, may be used. In addition, preferably, the carrier has a particle size of about 15 to 100 [μm].

In the present embodiment, lubricant having lubricity is added in the toner. The lubricant is charged to a polarity opposite to the charging polarity of the toner, and has a particle size smaller than that of the toner. In the present embodiment, the lubricant is positively charged.

Examples of the lubricant include fatty acid metal salt, silicone oil, fluorine resin and the like, which may be used alone or in combination. Among them, fatty acid metal salt is preferable. The fatty acid is preferably a straight-chain hydrocarbon, and for example, myristic acid, palmitic acid, stearic acid, oleic acid and the like are preferable. Among them, stearic acid is more preferable. Examples of the metal include lithium, magnesium, calcium, strontium, zinc, cadmium, aluminum, celium, titanium, and iron. Among them, zinc stearate, stearic acid magnesium, stearic acid aluminum, stearic acid iron and the like are preferable, and zinc stearate is most preferable.

Developing device 412 includes developing sleeve 412A that is disposed to face photoconductor drum 413 with the development region therebetween. For example, a direct current developing bias having a polarity same as the charging polarity of charging apparatus 414, or a developing bias in which a direct current voltage having a polarity same as the charging polarity of charging apparatus 414 is superimposed on an AC voltage is applied to developing sleeve 412A. Thus, reversal development for attaching toner to an electrostatic latent image formed by exposing device 411 is performed.

Drum cleaning device 415 includes plate-shaped drum cleaning blade 415A composed of an elastic body configured to be brought into contact with the surface of photoconductor drum 413, and the like, and removes the toner that remains on the surface of photoconductor drum 413 without being transferred to intermediate transfer belt 421 after the primary transfer.

Intermediate transfer unit 42 includes intermediate transfer belt 421, primary transfer roller 422, a plurality of support rollers 423, secondary transfer roller 424, belt cleaning device 426 and the like.

Intermediate transfer unit 42 is composed of an endless belt, and is stretched around the plurality of support rollers 423 in a loop form. At least one of the plurality of support rollers 423 is composed of a driving roller, and the others are each composed of a driven roller. Preferably, for example, roller 423A disposed on the downstream side in the belt travelling direction relative to primary transfer rollers 422 for K-component is a driving roller. With this configuration, the travelling speed of the belt at a primary transfer nip can be easily maintained at a constant speed. When driving roller 423A rotates, intermediate transfer belt 421 travels in arrow A direction at a constant speed.

Intermediate transfer belt 421 is a belt having conductivity and elasticity which includes on the surface thereof a high resistance layer having a volume resistivity of 8 to 11 [ log Ω·cm]. Intermediate transfer belt 421 is rotationally driven by a control signal from control section 100. It is to be noted that the material, thickness and hardness of intermediate transfer belt 421 are not limited as long as intermediate transfer belt 421 has conductivity and elasticity.

Primary transfer rollers 422 are disposed on the inner periphery side of intermediate transfer belt 421 to face photoconductor drums 413 of respective color components. Primary transfer rollers 422 are brought into pressure contact with photoconductor drums 413 with intermediate transfer belt 421 therebetween, whereby a primary transfer nip for transferring a toner image from photoconductor drums 413 to intermediate transfer belt 421 is formed.

Secondary transfer roller 424 is disposed to face backup roller 423B disposed on the downstream side in the belt travelling direction relative to driving roller 423A, at a position on the outer peripheral surface side of intermediate transfer belt 421. Secondary transfer roller 424 is brought into pressure contact with backup roller 423B with intermediate transfer belt 421 therebetween, whereby a secondary transfer nip for transferring a toner image from intermediate transfer belt 421 to sheet S is formed.

When intermediate transfer belt 421 passes through the primary transfer nip, the toner images on photoconductor drums 413 are sequentially primary-transferred to intermediate transfer belt 421. To be more specific, a primary transfer bias is applied to primary transfer rollers 422, and an electric charge of the polarity opposite to the polarity of the toner is applied to the rear side, that is, a side of intermediate transfer belt 421 that makes contact with primary transfer rollers 422 whereby the toner image is electrostatically transferred to intermediate transfer belt 421.

Thereafter, when sheet S passes through the secondary transfer nip, the toner image on intermediate transfer belt 421 is secondary-transferred to sheet S. To be more specific, a secondary transfer bias is applied to secondary transfer roller 424, and an electric charge of the polarity opposite to the polarity of the toner is applied to the rear side, that is, a side of sheet S that makes contact with secondary transfer roller 424 whereby the toner image is electrostatically transferred to sheet S. Sheet S on which the toner images have been transferred is conveyed toward fixing section 60.

Belt cleaning device 426 removes transfer residual toner which remains on the surface of intermediate transfer belt 421 after a secondary transfer. A configuration in which a secondary transfer belt is installed in a stretched state in a loop form around a plurality of support rollers including a secondary transfer roller, that is, a so-called belt-type secondary transfer unit, may also be adopted in place of secondary transfer roller 424.

Fixing section 60 includes upper fixing section 60A having a fixing side member disposed on a fixing surface side, that is, a side of the surface on which a toner image is formed, of sheet S, lower fixing section 60B having a back side supporting member disposed on the rear surface side, that is, a side of the surface opposite to the fixing surface, of sheet S, heating source 60C, and the like. The back side supporting member is brought into pressure contact with the fixing side member, whereby a fixing nip for conveying sheet S in a tightly sandwiching manner is formed.

At the fixing nip, fixing section 60 applies heat and pressure to sheet S on which a toner image has been secondary-transferred to fix the toner image on sheet S. Fixing section 60 is disposed as a unit in fixing part F. In addition, fixing part F may be provided with an air-separating unit that blows air to separate sheet S from the fixing side member or the back side supporting member.

Sheet conveyance section 50 includes sheet feeding section 51, sheet ejection section 52, conveyance path section 53 and the like. Three sheet feed tray units 51*a* to 51*c* included in sheet feeding section 51 store sheets S (standard sheets, special sheets) discriminated on the basis of the basis weight, the size, and the like, for each type set in advance. Conveyance path section 53 includes a plurality of conveyance rollers such as registration roller body 53*a*.

Sheets S stored in sheet tray units 51*a* to 51*c* are output one by one from the uppermost, and conveyed to image forming section 40 by conveyance path section 53. At this time, the registration roller section in which the pair of registration rollers 53*a* are arranged corrects skew of sheet S fed thereto, and the conveyance timing is adjusted. Then, in image forming section 40, the toner image on intermediate transfer belt 421 is secondary-transferred to one side of sheet S at one time, and a fixing process is performed in fixing section 60. Sheet S on which an image has been formed is ejected out of the image forming apparatus by sheet ejection section 52 including sheet ejection rollers 52*a*.

Figure 3:
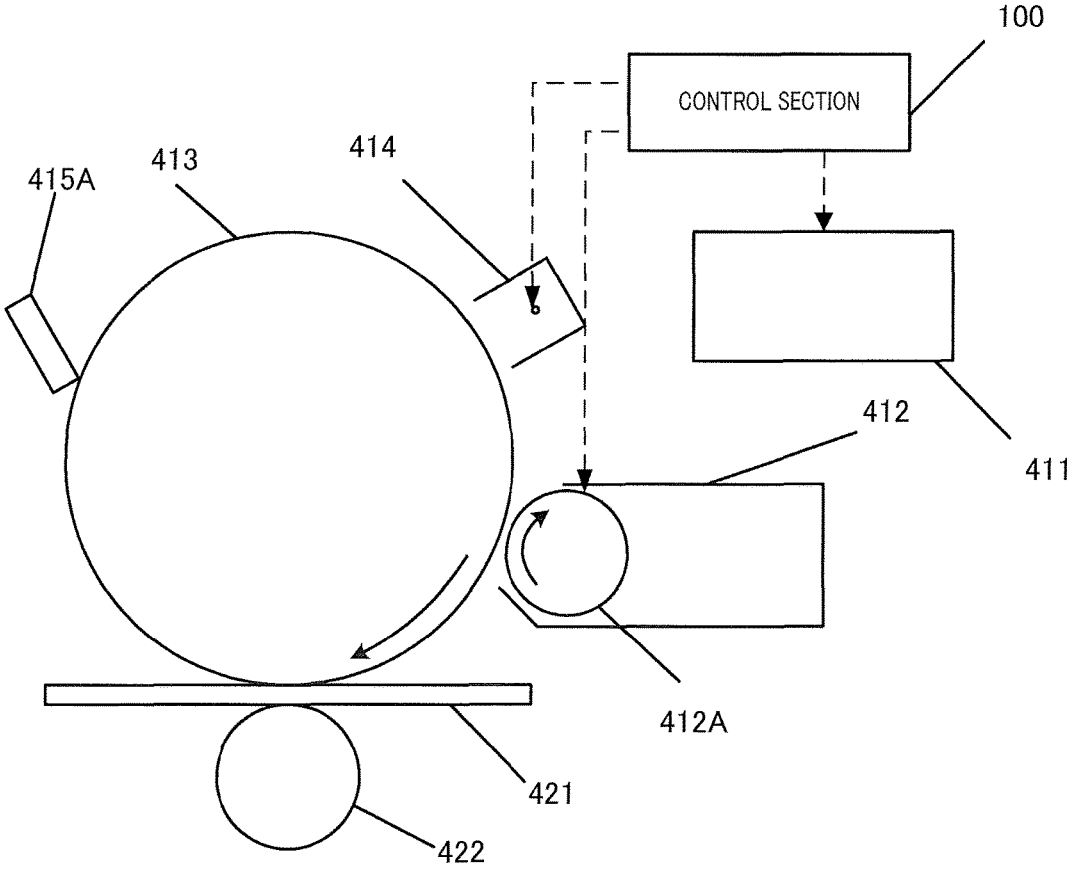
FIG. 3 illustrates peripheries of the image forming apparatus and a control section of Embodiment 1.

Next, with reference to FIG. 3, peripherals of developing device 412 and control section 100 in Embodiment 1 are described in detail.

As illustrated in FIG. 3, control section 100 controls the light exposure amount of exposing device 411, the developing bias applied to developing sleeve 412A and the charging potential of charging device 414. In other words, control section 100 controls light exposure potential Vi which is the surface potential of photoconductor drum 413 subjected to light exposure of exposing device 411, the direct current component of developing bias Vdc, and charging potential Vo which is the surface potential of photoconductor drum 413 charged by charging device 414. Light exposure potential Vi corresponds to a first surface potential and a second surface potential.

In the case where a toner image having a low area rate is continuously printed, that is, in the case where the total average area ratio of toner images in a printing job is smaller than a predetermined area ratio, control section 100 operates to form a patch image in the toner image formation region different from the patch image formation region on photoconductor drum 413. When forming a patch image, control section 100 operates to set a development condition of developing device 412 different from the development condition of toner image formation. In other words, control section 100 operates such that a first development condition for forming a patch image and a second development condition for forming a toner image are different from each other.

Specifically, at the time of patch image formation, control section 100 operates to set an absolute value of developing bias Vdc to an value smaller than that of toner image formation. That is, control section 100 operates such that a first potential difference between a first developing bias and light exposure potential Vi at the time of patch image formation is smaller than a second potential difference between a second developing bias and light exposure potential Vi at the time of toner image formation. Control section 100 sets the first developing bias and second developing bias different from each other such that the first potential difference is smaller than the second potential difference.

In this manner, at the time of patch image formation, the electric field generated from developing sleeve 412A toward photoconductor drum 413 is smaller than that of toner image formation, and thus the force attracting toner toward the photoconductor drum 413 side decreases. Therefore, the toner consumption amount in patch image formation is smaller than the toner consumption amount in toner image formation.

Figure 4:
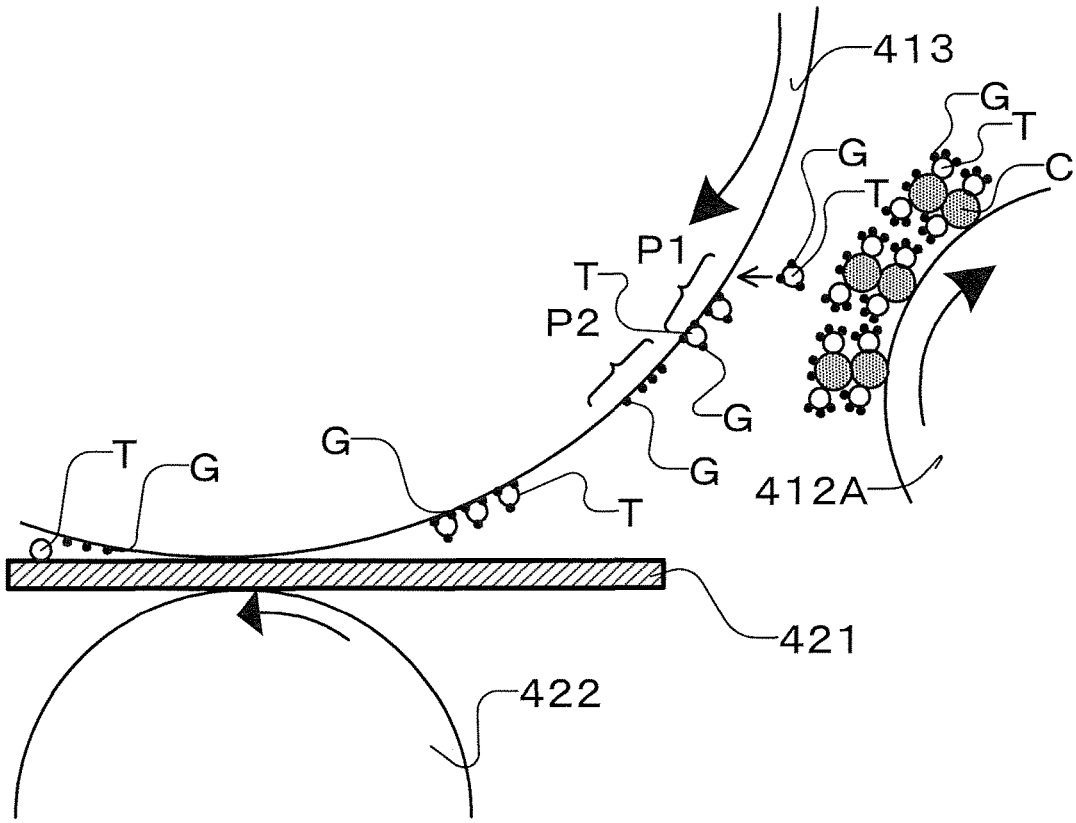
FIG. 4 is an explanatory view of movement of toner and lubricant.
Figure 5A:
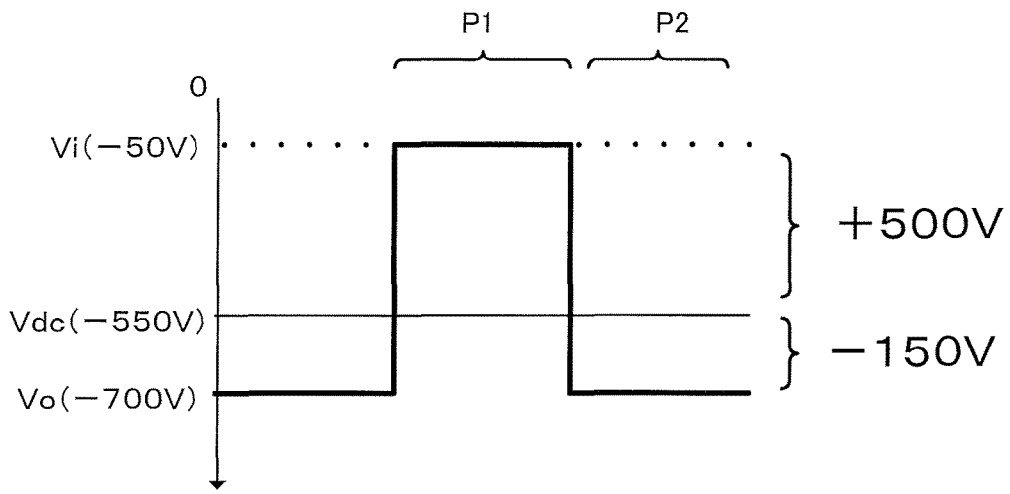
FIG. 5A illustrates a surface potential of a photoconductor drum and a developing bias at the time of toner image formation.
Figure 5B:
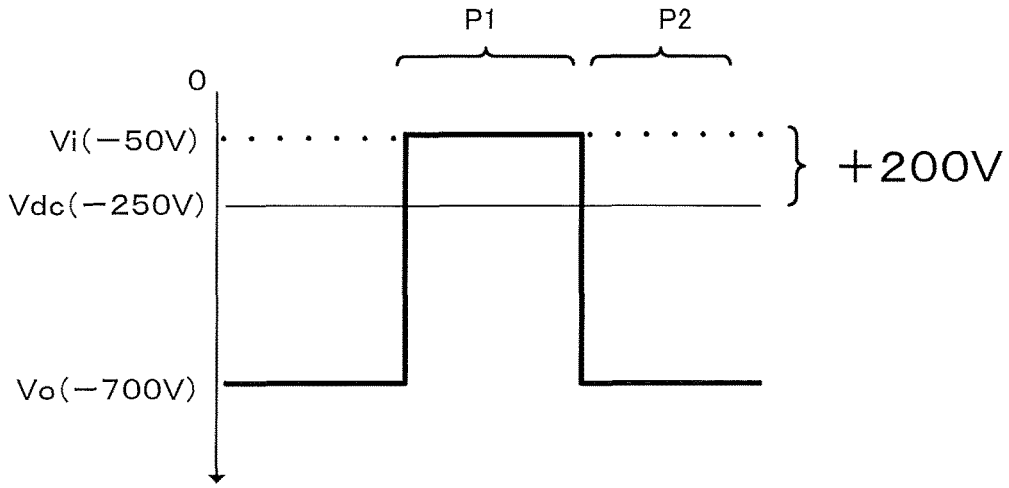
FIG. 5B illustrates a surface potential of a photoconductor drum and a developing bias at the time of patch image formation.
Figure 6:
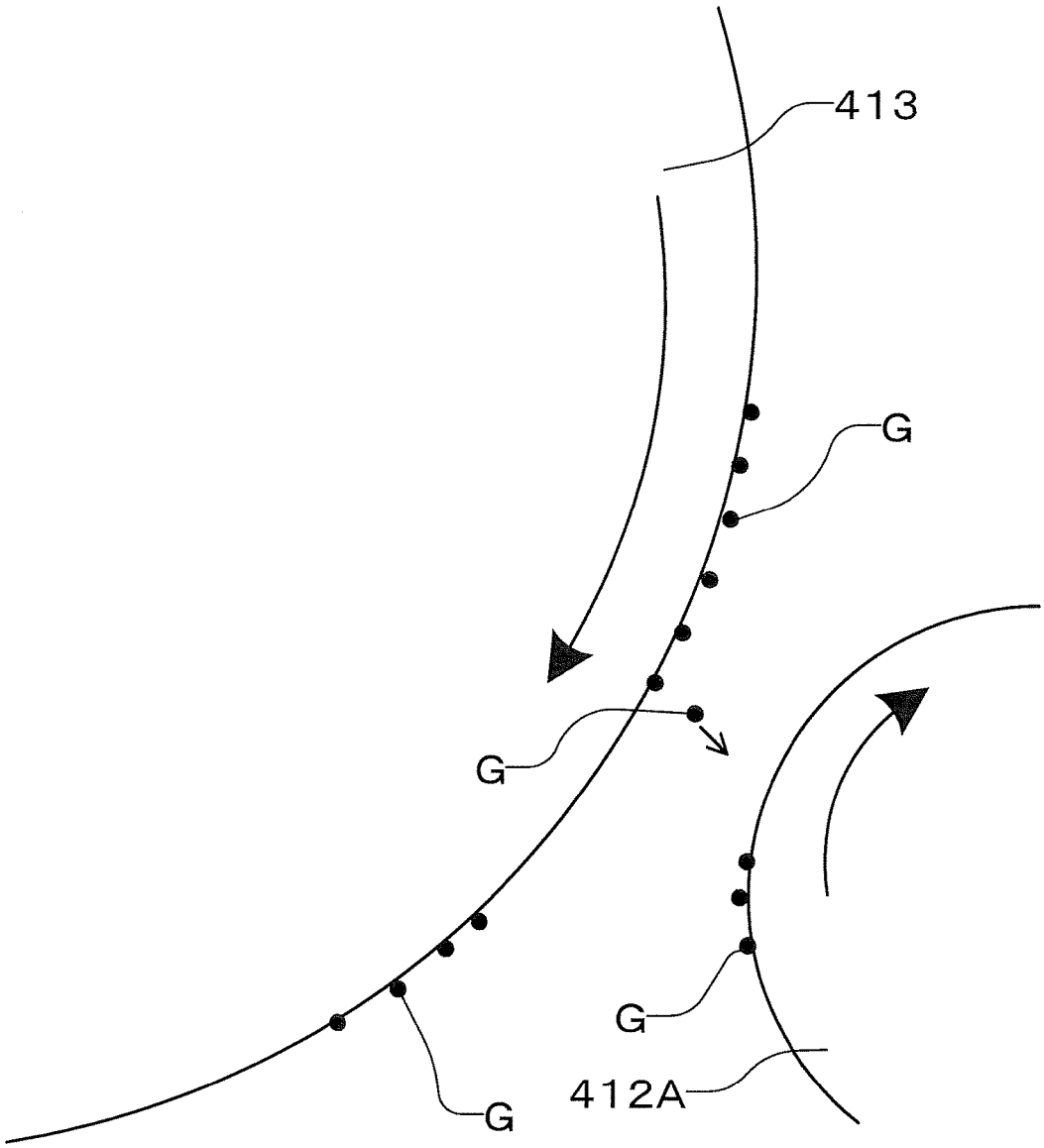
FIG. 6 is an explanatory view of a state where lubricant is collected by a developing sleeve.

Now a series of operations of supplying and collecting lubricant in image forming apparatus 1 including control section 100 having the above-mentioned configuration is described. FIG. 4 is an explanatory view of movement of toner T and lubricant G FIG. 5A shows the surface potential and developing bias Vdc of photoconductor drum 413 at the time of toner image formation, and FIG. 5B shows the surface potential and developing bias Vdc of photoconductor drum 413 at the time of patch image formation. FIG. 6 is an explanatory view of a state where lubricant G is collected by developing sleeve 412A.

It is to be noted that, in the present embodiment, light exposure potential Vi of photoconductor drum 413 is set to −50 [V]. In addition, charging potential Vo of photoconductor drum 413 is set to −700 [V]. In addition, developing bias Vdc at the time of toner image formation is set to −550 [V]. These voltage values may be appropriately set in accordance with the embodiment.

In addition, in the following description, the potential difference in image region P1, that is, the potential difference of light exposure potential Vi with respect to developing bias Vdc, is referred to as "image part potential difference," and the potential difference of background region P2 which is a white part, that is, the potential difference of charging potential Vo with respect to developing bias Vdc, is referred to as "background part potential difference."

First, supply of lubricant G onto photoconductor drum 413 is described. As illustrated in FIG. 4 and FIG. 5A, when a printing job is started, toner T mixed with carrier C is borne on developing sleeve 412A on which developing bias Vdc has been applied, and is moved to a position opposite to photoconductor drum 413 with rotation of developing sleeve 412A.

In image region P1, the image part potential difference is +500 [V], and therefore a positive electric field acts in a direction from developing sleeve 412A toward photoconductor drum 413. Therefore, negatively charged toner T moves to the photoconductor drum 413 side. At this time, lubricant G added in toner T moves onto photoconductor drum 413 together with toner T.

Along with rotation of photoconductor drum 413, toner T and lubricant G moved onto photoconductor drum 413 move to a position between photoconductor drum 413 and primary transfer roller 422 with intermediate transfer belt 421 therebetween. Since a positive transfer voltage has been applied to primary transfer roller 422, negative toner T moves onto intermediate transfer belt 421. While the transfer voltage is set to 500 [V] in the present embodiment, the transfer voltage may be appropriately set in accordance with the embodiment.

At this time, lubricant G has a positive polarity, and is pressed against photoconductor drum 413 with an electric field generated between primary transfer roller 422 and photoconductor drum 413. Consequently, lubricant G is separated from toner T and stays on photoconductor drum 413. In addition, since photoconductor drum 413 and intermediate transfer belt 421 are in contact with each other, a greater electric field is formed and consequently lubricant G is more easily separated from toner T in comparison with photoconductor drum 413 and developing sleeve 412A separated from each other. In this manner, lubricant G is supplied onto photoconductor drum 413.

On the other hand, in background region P2, the background part potential difference is −150 [V], and thus a negative electric field acts in a direction from developing sleeve 412A toward photoconductor drum 413. Therefore, negatively charged toner T does not move to the photoconductor drum 413 side. However, lubricant G charged to a positive polarity is separated from toner T, and moves to the photoconductor drum 413 side. In addition, lubricant G separated from toner T on developing sleeve 412A also moves to the photoconductor drum 413 side. Therefore, in the developing device in which developing sleeve 412A is disposed, lubricant G may become insufficient, and lubricant G supplied to photoconductor drum 413 may become insufficient.

In the present embodiment, however, in the case where a toner image having a low area rate with a large background region P2 is continuously printed, that is, in the case where the total average area ratio is smaller than a predetermined area ratio, a patch image is formed on photoconductor drum 413. In this manner, new toner T and lubricant G adhering to toner T are taken into the developing device from the toner housing part in developing device 412, and the developing device is replenished with new lubricant G, thus preventing insufficiency of lubricant G in the developing device.

Incidentally, the toner image on photoconductor drum 413 used for the patch image is discarded as it is. Therefore, when a large number of patch images are formed to increase the supply amount of lubricant G on photoconductor drum 413 in the case where a toner image having a low area rate is continuously printed, the consumption amount of toner T increases.

In the present embodiment, however, as illustrated in FIG. 4 and FIG. 5 B, when control section 100 forms a patch image in the toner image formation region different from the patch image formation region on photoconductor drum 413, developing bias Vdc is set to a value smaller than that of toner image formation. In this manner, the image part potential difference decreases, and the intensity of the positive electric field acting from developing sleeve 412A toward photoconductor drum 413 decreases. As a result, the movement amount of toner T becomes smaller than that of toner image formation, and thus the amount of toner T used for the patch image which is to be discarded can be reduced, and in turn, cost can be reduced.

In addition, since the image part potential difference is smaller than that of toner image formation, the separation force of lubricant G charged to a positive polarity from toner T is smaller than that of toner image formation. Therefore, lubricant G adhering to toner T easily moves to the developing device photoconductor drum 413 side, and thus even with toner T having an amount smaller than that of toner image formation, lubricant G can be efficiently supplied onto photoconductor drum 413.

Next, collection of lubricant G on photoconductor drum 413 with developing sleeve 412A is described.

As illustrated in FIG. 6, photoconductor drum 413 again moves to a position opposite to developing sleeve 412A in the state where the toner is collected by a drum cleaning device or the like and only lubricant G is held on photoconductor drum 413. At this time, in the case of image region P1, that is, a region in which developing bias Vdc is small relative to light exposure potential Vi, a negative electric field from photoconductor drum 413 toward developing sleeve 412A acts in that part. Therefore, lubricant G charged to a positive polarity moves to the developing sleeve 412A side. Here, when the potential difference between photoconductor drum 413 and developing sleeve 412A is large, the amount of lubricant G which moves to the developing sleeve 412A side is large.

In the present embodiment, however, as illustrated in FIG. 5B, control section 100 reduces the image part potential difference at the time of patch image formation, and thus the intensity of the negative electric field from photoconductor drum 413 toward developing sleeve 412A is smaller than that of toner image formation. Thus, the amount of lubricant G which moves to the developing sleeve 412A side can be reduced, and in turn, the amount of lubricant G on photoconductor drum 413 can be maintained.

As described, in the present embodiment, in a series of operations of supplying and collecting lubricant G at the time of patch image formation, lubricant G can be efficiently supplied onto photoconductor drum 413 even when the amount of toner T is smaller than that of toner image formation, and the collection amount of lubricant G on photoconductor drum 413 can be suppressed. Consequently, the cost of supplying lubricant G to photoconductor drum 413 can be reduced.

Figure 7:
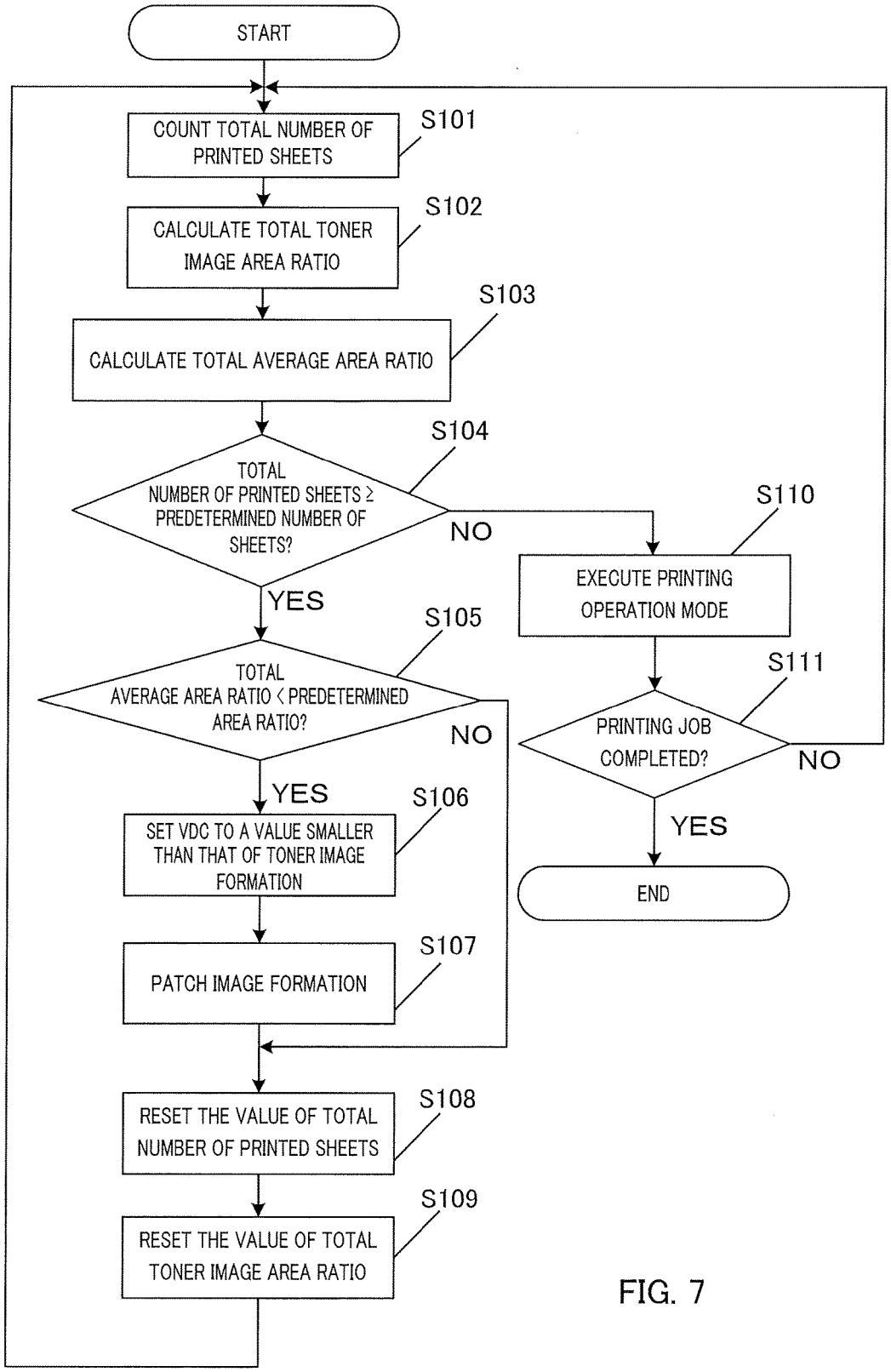
FIG. 7 is a flowchart of an exemplary operation of supplying lubricant to a photoconductor drum of the image forming apparatus of Embodiment 1.

FIG. 7 is a flowchart of an exemplary operation of supplying lubricant to photoconductor drum 413 in image forming apparatus 1 of Embodiment 1. The processing of FIG. 7 is executed when control section 100 receives an execution request of a printing job.

First, control section 100 refers to image formation information stored in storage section 72, and counts the total number of printed sheets in the currently performed printing job (step S101).

Next, control section 100 refers to the image formation information to calculate the total toner image area ratio at that time point in the printing job (step S102). The toner image area ratio is a ratio of image region P1, that is, the region having a color other than white with respect to the printing region of sheet S. After step S102, control section 100 advances the process to step S103.

Next, control section 100 calculates a value obtained by dividing the total average area ratio, that is, the total toner image area ratio by the total number of printed sheets (step S103).

Next, control section 100 determines whether the total number of printed sheets is not smaller than a predetermined number of sheets (for example, 1,000 sheets) (step S104).

When it is determined that the total number of printed sheets is not smaller than the predetermined number of sheets (YES at step S104), control section 100 determines whether the total average area ratio is smaller than a predetermined area ratio (for example, 5%). When it is determined that the total average area ratio is not smaller than the predetermined area ratio (No at step S105), the process is advanced to step S108.

On the other hand, when the total average area ratio is smaller than a predetermined area ratio (YES at step S105), control section 100 operates to set developing bias Vdc to a value smaller than that of toner image formation (step S106). Next, control section 100 forms a patch image, (step S107). Thereafter, the process is advanced to step S108.

At step S108, control section 100 resets the value of the total number of printed sheets. Next, control section 100 resets the value of the total toner image area ratio (step S109). Thereafter, the process is returned to the process before step S101.

Returning to the determination process of step S104, when the total number of printed sheets is smaller than the predetermined number of sheets (No at step S104), control section 100 executes a printing operation mode (step 5110). Finally, control section 100 determines whether the printing job has been completed (step S111). When it is determined that the printing job has not been completed, (No at step S111), the process is returned to the process before step S101. On the other hand, when it is determined that the printing job has been completed (YES at step S111), image faulting apparatus 1 terminates the processing of FIG. 7.

As described above, image forming apparatus 1 of the present embodiment includes photoconductor drum 413 to which lubricant is supplied, developing device 412 configured to form a toner image and a patch image different from the toner image on photoconductor drum 413, and control section 100 configured to operate such that a first development condition for forming the patch image and a second development condition for forming the toner image are different from each other.

According to the above-mentioned configuration of the present embodiment, in the case where a toner image having a low area rate is continuously printed, control section 100 sets developing bias Vdc smaller than that of toner image formation when forming a patch image. In this manner, the image part potential difference becomes small, and the toner movement amount becomes smaller than that of toner image formation. Consequently, the amount of toner used for the patch image which is to be discarded can be reduced, and in turn, cost can be reduced.

In addition, since the image part potential difference is smaller than that of toner image formation, lubricant G adhering to toner T can easily move from the developing device to the photoconductor drum 413 side, and lubricant G can be efficiently supplied onto photoconductor drum 413 even when the amount of toner T is smaller than that of toner image formation. In addition, since control section 100 reduces the image part potential difference at the time of patch image formation, the amount of lubricant G which moves to the developing sleeve 412A side can be suppressed in comparison with the case of toner image formation, and in turn, the amount of lubricant G on photoconductor drum 413 can be maintained.

As described, in the present embodiment, in a series of operations of supplying and collecting lubricant G in patch image formation, lubricant G can be efficiently supplied onto photoconductor drum 413 even when the amount of toner T is smaller than that of toner image formation, and the collection amount of lubricant G on photoconductor drum 413 can be suppressed. Therefore, the cost for supplying lubricant G to photoconductor drum 413 can be reduced.

In addition, since control section 100 forms a patch image in the patch formation region different from the toner image formation region, it is not necessary to interrupt the printing operation. Therefore, the number of prints per unit time is not reduced, and the efficiency of printing can be improved.

In addition, since control section 100 forms a patch image in accordance with the total toner image area ratio, the amount of lubricant G can be easily uniformized at the time of patch image formation in the axial direction of photoconductor drum 413. Therefore, in comparison with the case where different images arranged in the axial direction are formed, the difference of the amount of lubricant G in the axial direction on photoconductor drum 413 can be reduced. In this manner, generation of image noise due to the difference of the amount of lubricant G in the axial direction can be suppressed. In addition, the lifetime of drum cleaning blade 415A can be increased.

In addition, since control section 100 forms a patch image after a certain number of sheets are printed, lubricant G may be supplied onto photoconductor drum 413 only when lubricant G on photoconductor drum 413 may possibly become insufficient.

In addition, since the particle size of the lubricant is smaller than the particle size of the toner, the lubricant can be easily moved to photoconductor drum 413 without being separated from the toner at the time when the toner moves from developing sleeve 412A to photoconductor drum 413.

In addition, while developing bias Vdc applied to developing sleeve 412A is varied to vary the image part potential difference in the above-mentioned configuration, the present invention is not limited to this example, and the surface potential of photoconductor drum 413 may be changed to change the image part potential difference.

Figure 8A:
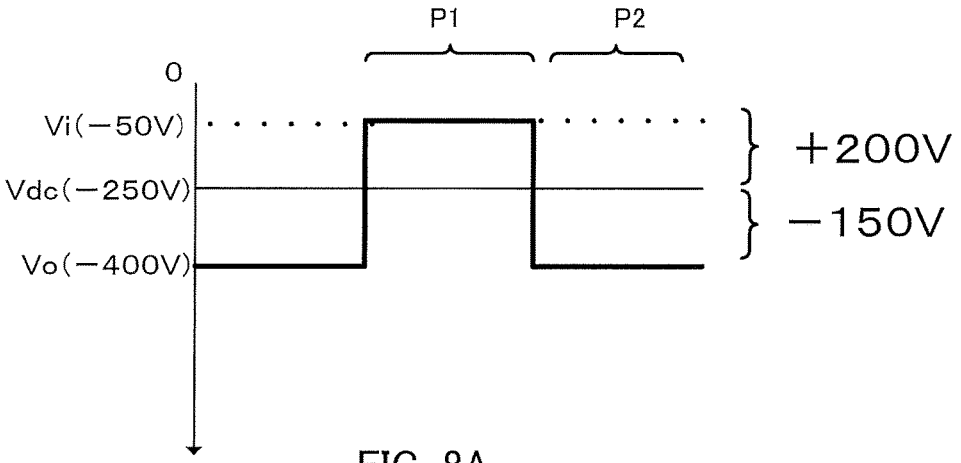
FIG. 8A illustrates a surface potential of the photoconductor drum and a developing bias at the time of patch image formation according to modification 1.
Figure 8B:
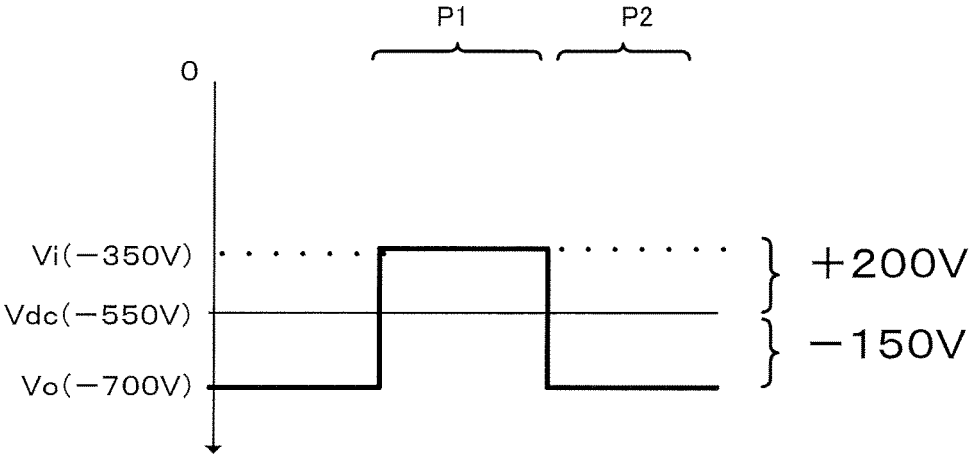
FIG. 8B illustrates a surface potential of the photoconductor drum and a developing bias at the time of patch image formation according to modification 2.

FIG. 8A shows a surface potential of a photoconductor drum and a developing bias at the time of patch image formation according to modification 1, and FIG. 8B shows a surface potential of a photoconductor drum and a developing bias at the time of patch image formation according to modification 2.

As illustrated in FIG. 8A, in modification 1, the charging amount by charging device 414 is set to a small value and surface potential Vo of photoconductor drum 413 and developing bias Vdc are set to −400 [V] and −250 [V], respectively, to thereby set the image part potential difference and the background part potential difference to +200 [V] and −150 [V], respectively. In this manner, the image part potential difference is small with respect to +500 [V] of toner image formation, and thus effects similar to those of the above-mentioned configurations of can be obtained.

Incidentally, when developing bias Vdc is set to a small value without changing surface potential Vo of photoconductor drum 413, the background part potential difference is increased in the negative direction, and consequently the amount of lubricant G supplied to background region P2 increases. In modification 1, however, surface potential Vo of photoconductor drum 413 is set to a small value to maintain the background part potential difference while setting the image part potential difference to a small value, and thus increase of the amount of lubricant G in background region P2 can be suppressed. In view of this, preferably, when varying developing bias Vdc, control section 100 also varies charging potential Vo of photoconductor drum 413.

As illustrated in FIG. 8B, in modification 2, the light exposure amount by exposing device 411 is set to a small value, and surface potential Vi of photoconductor drum 413 is set to −350 [V], to thereby set the image part potential difference to +200 [V]. In this manner, the image part potential difference is set to a small value with respect to +500 [V] of toner image formation, and consequently effects similar to those of the above-mentioned configurations can be obtained.

In addition, in modification 2, the toner image area ratio is calculated for each of regions which are obtained by dividing photoconductor drum 413 in the axial direction, and the light exposure amount by exposing device 411 in each region is regulated to thereby regulate the supply amount of lubricant G in the axial direction of photoconductor drum 413.

Next, Embodiment 2 is described in detail with reference to the accompanying drawings. It is to be noted that components substantially similar to those of Embodiment 1 are denoted with the same reference numerals, and the description thereof is omitted.

Figure 9:
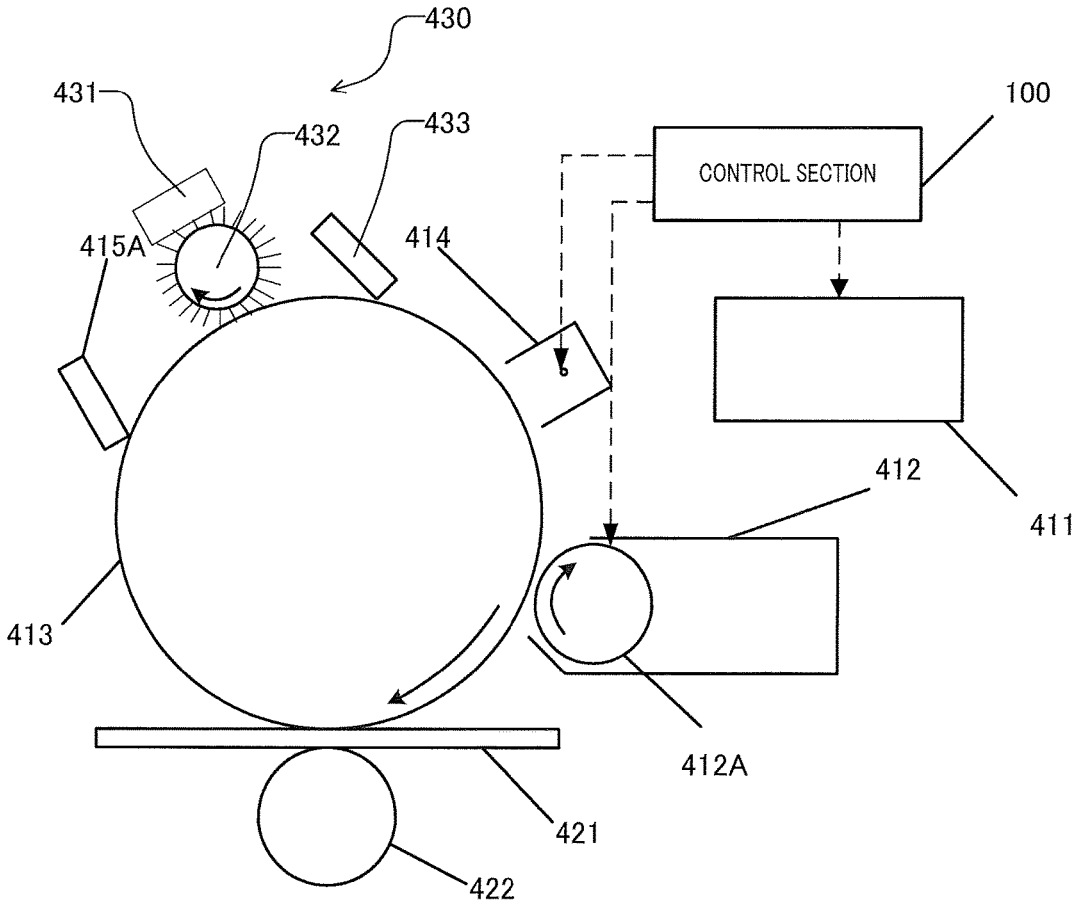
FIG. 9 illustrates peripheries of a developing device and a control section of Embodiment 2.

FIG. 9 illustrates peripherals of developing device 412 and control section 100 according to Embodiment 2.

As illustrated in FIG. 9, developing device 412 further includes lubricant application section 430 on the downstream side of drum cleaning blade 415A in the rotational direction of photoconductor drum 413 in the configuration of Embodiment 1. In the following description, the rotational direction of photoconductor drum 413 is simply referred to as "rotational direction."

Lubricant application section 430 includes lubricant rod 431, brush 432, and blade 433.

Lubricant rod 431 is formed by compression-molding or the like into a rod shape with the material of lubricant G, and is disposed at a position separated from photoconductor drum 413.

Brush 432 is rotatably disposed between lubricant rod 431 and photoconductor drum 413, and is in contact with lubricant rod 431 and photoconductor drum 413. Brush 432 rotates to scrape lubricant G from lubricant rod 431 and holds the lubricant G in brush 432. Then, brush 432 supplies lubricant G held therein onto photoconductor drum 413.

Blade 433 is a rubber levelling blade, and is disposed on the downstream side of lubricant rod 431 and brush 432 in the rotational direction. Blade 433 is configured to press lubricant G supplied on photoconductor drum 413 against photoconductor drum 413. Pressed by blade 433, lubricant G is applied onto photoconductor drum 413.

Also with such a configuration, the toner consumption amount can be reduced at the time of patch image formation. In addition, when lubricant G is supplied to a patch image formation portion, lubricant G moves to the developing sleeve 412A side when the portion of photoconductor drum 413 faces developing sleeve 412A, as described above.

Also in Embodiment 2, however, the movement of lubricant G to the developing sleeve 412A side is suppressed, and the efficiency of supply of lubricant G in photoconductor drum 413 can be improved as with Embodiment 1. In addition, since the mixed amount of lubricant G to developing device 412 is small, the influence of fogging or the like on the image quality can be reduced.

While a development condition different from that of toner image formation is set by reducing the image part potential difference in the embodiments, the present invention is not limited to this. For example, a different development condition may be set by increasing the distance between the developing sleeve and the photoconductor drum, or by reducing the relative speed of the developing sleeve with respect to the photoconductor drum at a portion where the photoconductor drum and the developing sleeve face each other.

In addition, while control section 100 operates to vary the development condition at a timing between images during a printing job after a certain number of sheets are printed in the embodiments, the present invention is not limited to this. For example, control section 100 may perform that operation by interrupting the printing job after a certain number of sheets are printed, or may perform that operation after the printing operation. In addition, in the case where variation of the amount of lubricant G on photoconductor drum 413 can be estimated on the basis of the requested number of printing sheets and the toner image area ratio thereof, control section 100 may perform that operation before the printing operation.

In addition, the patch image formation method is not limited to that of the embodiments. For example, a patch image may be formed by temporarily interrupting the charging of photoconductor drum 413 with charging device 414, and by attaching toner to the entirety of a portion of photoconductor drum 413 where photoconductor drum 413 is not charged to form a so-called solid image. In this case, it suffices to apply a developing bias having an absolute value smaller than that of toner image formation to developing sleeve 412A.

While the invention made by the present inventor has been specifically described based on the preferred embodiments, it is not intended to limit the present invention to the above-mentioned preferred embodiments but the present invention may be further modified within the scope and spirit of the invention defined by the appended claims.

The present invention is applicable to an image forming system composed of a plurality of units including an image forming apparatus. The units include, for example, a post-processing apparatus, an external apparatus such as a control apparatus connected with a network, and the like.

Finally, results of evaluation experiments are described.

[First Experiment]

Figure 10:
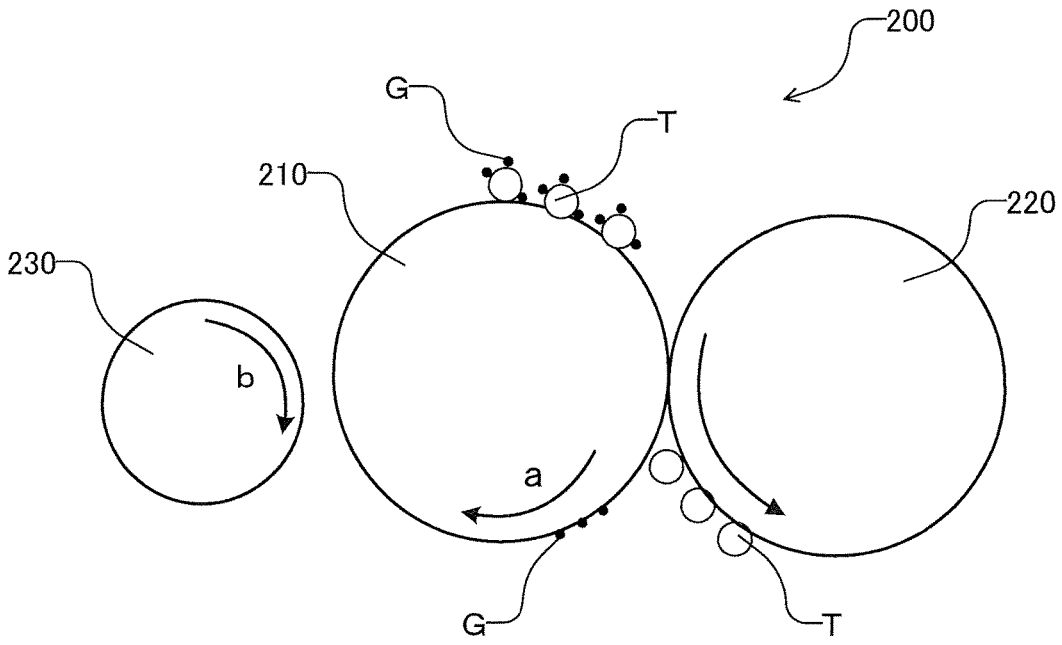
FIG. 10 illustrates an evaluation apparatus of a first experiment.
Figure 11:
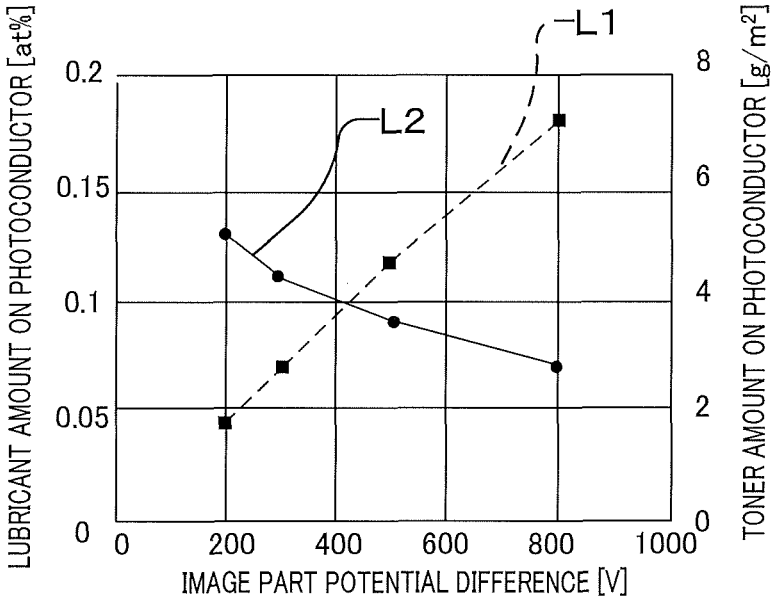
FIG. 11 shows results of the first experiment.

In the first experiment, variation of the amount of lubricant G on photoconductor drum 210 when the potential difference between the surface potential photoconductor drum 210 and the developing bias is varied was tested. FIG. 10 illustrates an evaluation apparatus according to the first experiment, and FIG. 11 shows experiment results of the first experiment.

As illustrated in FIG. 10, an evaluation apparatus composed of photoconductor drum 210, transfer roller 220 and developing sleeve 230 was used as evaluation apparatus 200 according to the first experiment. The evaluation condition was as follows.

(1) Photoconductor Drum

A photoconductor drum in which a photosensitive layer made of polycarbonate resin and having a thickness of 25 [μm] is provided on the surface of a cylinder member made of aluminum and having an outer diameter of 100 [mm] and a length of 100 [mm] was used as photoconductor drum 210. Photoconductor drum 210 rotates in the "a" direction at a speed of 400 [mm/sec].

(2) Transfer Roller

A transfer roller in which a conductive rubber layer is provided on the surface was used as transfer roller 220. Transfer roller 220 makes contact with photoconductor drum 210, and rotates along with photoconductor drum 210.

(3) Developing Sleeve

A cylinder member made of aluminum and having an outer diameter of 50 [mm] was used as developing sleeve 230. Developing sleeve 230 is disposed to face photoconductor drum 210 with a distance of 300 [μm] therebetween, and rotates in the "b" direction at a speed of 600 [mm/sec].

(4) Toner

A toner in which zinc stearate is added as lubricant G was used as toner T.

In the above-mentioned evaluation apparatus 200, photoconductor drum 210 was connected to GND, the transfer voltage of transfer roller 220 was set to 500 [V], and a developing bias on which an AC voltage having a frequency of 10,000 [Hz] and an amplitude of 900 [V] is superimposed was applied to developing sleeve 230 for a certain period during one rotation of photoconductor drum 210. In addition, toner of 260 [g/m$^2$] was held on the peripheral surface of developing sleeve 230.

When photoconductor drum 210 is rotated in one rotation with developing sleeve 230 rotated in the above-mentioned evaluation apparatus 200, a toner image is formed on photoconductor drum 210 and the toner image is transferred to transfer roller 220. After the transfer, lubricant G detached from the toner image is attached on photoconductor drum 210. Thereafter, toner T on transfer roller 220 is cleaned up without cleaning up photoconductor drum 210, and this operation is repeated. In this manner, a state from development to completion of the transfer in an actual machine can be simulated.

With use of the above-mentioned evaluation apparatus 200, in the state where the direct current component of the developing bias is changed, the process up to the cleaning of toner T after the transfer was repeated five times, and thereafter the amount of lubricant G supplied on photoconductor drum 210 was examined. The developing bias was set to −200 to −800 [V]. That is, the potential difference between photoconductor drum 210 and developing sleeve 230 was set to 200 to 800 [V]. In addition, a ratio of zinc to a desired zinc stearate which is obtained with use of X-ray photoelectron spectroscopy apparatus was used as a substitute for the amount of lubricant G.

FIG. 11 shows results of the first experiment. In FIG. 11, broken line L1 indicates the amount of toner T on photoconductor drum 210, and solid line L2 indicates the amount of lubricant G on photoconductor drum 210. In this manner, it was confirmed that as the potential difference between photoconductor drum 210 and developing sleeve 230 decreases, the amount of lubricant G on photoconductor drum 210 increases. In addition, it was confirmed that the amount of toner T on photoconductor drum 210 decreases as the potential difference decreases.

Incidentally, since lubricant G having a diameter smaller than that of toner T adheres to toner T and moves to the photoconductor drum 210 side, the amount of lubricant G supplied onto photoconductor drum 210 may possibly increase as the amount of toner T on photoconductor drum 210 increases when the image part potential difference is increased. In practice, however, while the amount of toner T on photoconductor drum 210 increases when the image part potential difference increases, the amount of lubricant G on photoconductor drum 210 decreases as shown in the results shown in FIG. 11.

The reason for this is as follows. Specifically, lubricant G remaining on photoconductor drum 210 after the transfer is again transported to developing sleeve 230 as described above. At this time, a force of moving lubricant G on photoconductor drum 210 to the developing sleeve 230 side is generated by the image part potential difference, and thus a part of lubricant G is collected by developing sleeve 230. When the image part potential difference is large, the force of moving lubricant G to the developing sleeve 230 side increases and the amount of lubricant G which moves to the developing sleeve 230 side increases, and as a result, the amount of lubricant G on photoconductor drum 210 decreases.

Since supply of lubricant G to photoconductor drum 210, and collection of lubricant G from photoconductor drum 210 occur at the position of developing sleeve 230, it is recognized that the amount of lubricant G on photoconductor drum 210 depends on the value of the image part potential difference. In addition, it was confirmed from the results shown in FIG. 10 that the image part potential difference is preferably set to a small value in order to supply a large amount of lubricant G onto photoconductor drum 210.

In addition, with reference to FIG. 11, the supply amount of lubricant G and the supply amount of toner T on photoconductor drum 210 of the toner image formation in FIG. 5A and the patch image formation of FIG. 8B are compared.

At the time of toner image formation, surface potential Vi of photoconductor drum 210 is set to −50 [V], and developing bias Vdc is set to −550 [V], and accordingly the image part potential difference is 500 [V]. As a result, at the time of toner image formation, the supply amount of toner T on the photoconductor drum is 4.7 [g/m$^2$], and the supply amount of lubricant G is 0.09 [at %].

On the other hand, at the time of patch image formation, when surface potential Vi of the photoconductor drum is set to −350 [V], the image part potential difference is 200 [V]. As a result, at the time of patch image formation, the supply amount of toner T on photoconductor drum 210 is 1.8 [g/m$^2$], and the supply amount of lubricant G is 0.13 [at %]. That is, the supply amount of lubricant G of patch image formation is 1.4 times the supply amount of lubricant G of toner image formation.

In addition, when converted into the supply amount of lubricant G per toner of 1 [g/m$^2$] on photoconductor drum 210, the supply amount of lubricant G of the time of toner image formation is 0.019 [at %], and the supply amount of lubricant G of patch image formation is 0.072 [at %]. That is, the supply amount of lubricant G of patch image formation per toner of 1 [g/m$^2$] is 3.8 times that of toner image formation. In other words, in the case where a constant amount of lubricant G is supplied to photoconductor drum 210, the amount of toner T of a patch image is 1/3.8 of the amount of toner T of toner image formation. Thus, by forming a patch image, the consumption amount of toner T can be effectively reduced, and in turn, cost can be reduced.

In addition, while the amount of lubricant G in the developing device decreases when a toner image having a low area rate is continuously printed, lubricant G can be efficiently supplied to photoconductor drum 413 by forming a patch image.

In addition, in general, when a toner image having a low area rate is continuously printed using a toner adding process, a patch image is formed in the toner image formation region and the patch image formation region. While a patch image is formed with an image part potential difference identical to that of toner image formation in the conventional technology, the image part potential difference of patch image formation is set to a value smaller than that of toner image formation in the present embodiment. In this manner, it was confirmed from results shown in FIG. 10 that, at the time of patch image formation, the supply amount of lubricant G to photoconductor drum 210 is increased and the supply amount of toner T can be reduced in comparison with the case of toner image formation.

In addition, from the results shown in FIG. 11, in the axial direction of photoconductor drum 210, the patch image preferably has a length equal to or greater than the length of the toner image formation region of toner image formation.

The reason for this is as follows. While toner T in the developing device is consumed and new toner T is supplied from the toner housing part into the developing device at the time of patch image formation, the amount of toner T developed per unit area on photoconductor drum 210 decreases when the image part potential difference is reduced, and the amount of toner T supplied into the developing device decreases.

To prevent such a situation, by increasing the area of patch image while the image part potential difference is kept at a small value, the amount of toner T supplied into the developing device increases. In this manner, it is possible to prevent the amount of newly supplied toner T from being excessively reduced. In addition, since lubricant G is supplied also from the newly supplied toner T, lubricant G can be efficiently supplied. In this case, it suffices to control the consumption amount of toner T to a value smaller than that of toner image formation.

[Second Experiment]

Figure 12A:
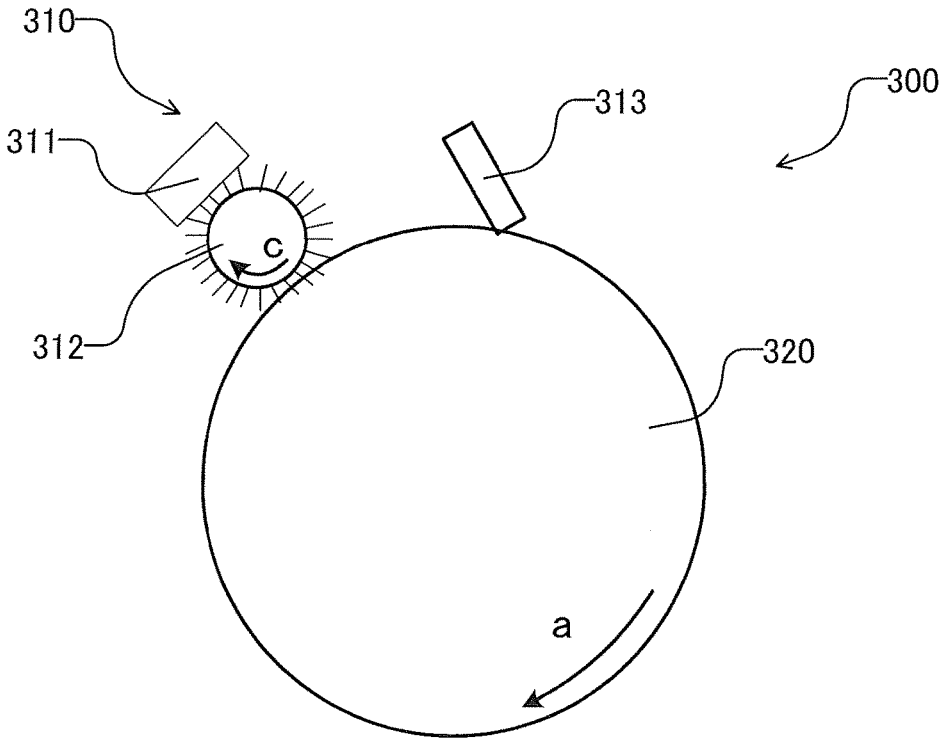
FIG. 12A illustrates a first evaluation apparatus of a second experiment.

In the second experiment, whether the lubricant on photoconductor drum 320 is collected by developing sleeve 330 was tested. FIG. 12A illustrates first evaluation apparatus 300 according to the second experiment, and FIG. 12B illustrates second evaluation apparatus 301 according to the second experiment.

Figure 12B:
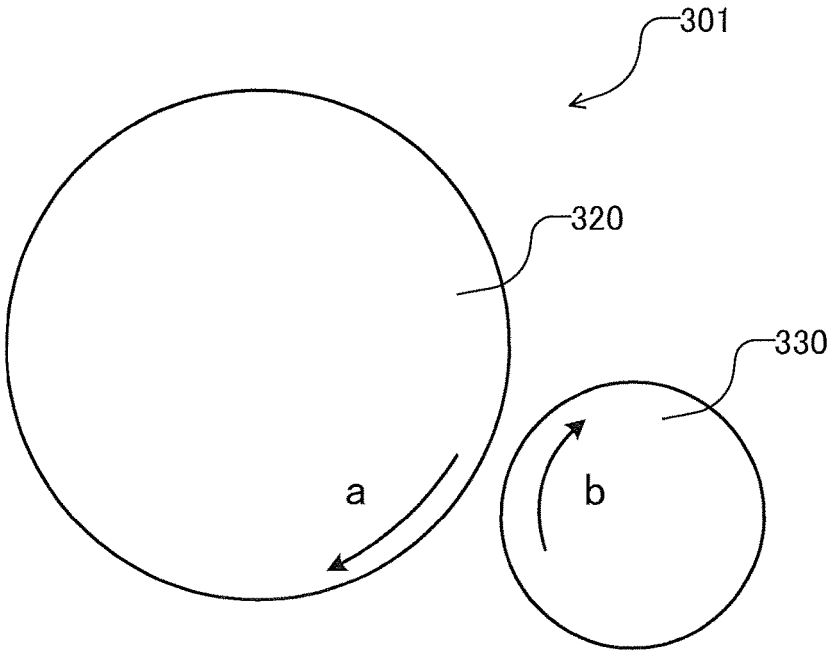
FIG. 12B illustrates a second evaluation apparatus of the second experiment.

First evaluation apparatus 300 composed of lubricant application section 310 and photoconductor drum 320 illustrated in FIG. 12A and second evaluation apparatus 301 composed of photoconductor drum 320 and developing sleeve 330 illustrated in FIG. 12B were used as the evaluation apparatuses according to the second experiment. The evaluation condition was as follows.

(1) First Evaluation Apparatus

A lubricant application section composed of lubricant rod 311 formed by compression-molding with zinc stearate into a rod shape, brush 312 made of polyester, and rubber blade 313 made of polyurethane was used as lubricant application section 310. Brush 312 rotates at a speed of 300 [mm/sec] in the "c" direction. In addition, photoconductor drum 320 of the condition identical to that of the first experiment was used.

(2) Second Evaluation Apparatus

An evaluation apparatus in which lubricant application section 310 is dismounted from first evaluation apparatus 300 after the experiment and only developing sleeve 330 faces photoconductor drum 320 with a distance of 300 [μm] therebetween was used as second evaluation apparatus 301. Developing sleeve 330 of the condition identical to that of the first experiment was used.

In the above-mentioned first evaluation apparatus 300 and second evaluation apparatus 301, photoconductor drum 320 is connected to GND, and a direct current component Vdc of 200 [V], a frequency of 10,000 [Hz], and an amplitude of 900 [V] were applied to developing sleeve 330. In addition, toner T of 260 [g/m$^2$] was held on the peripheral surface of developing sleeve 330.

With use of the above-mentioned first evaluation apparatus 300, brush 312 and photoconductor drum 320 are rotated for a certain period, and lubricant G is supplied onto photoconductor drum 320, and lubricant G is fixed on photoconductor drum 320 by rubber blade 313. The amount of lubricant G on photoconductor drum 320 at this time was measured with use of an X-ray photoelectron spectroscopy apparatus.

In addition, with use of second evaluation apparatus 301, photoconductor drum 320 was rotated 10 times while rotating developing sleeve 330, and the amount of lubricant G on photoconductor drum 320 was measured with use of an X-ray photoelectron spectroscopy apparatus.

It was confirmed that the amount of lubricant G on photoconductor drum 320 was 0.5 [at %] in first evaluation apparatus 300 whereas the amount of lubricant G on photoconductor drum 320 was 0.21 [at %] in second evaluation apparatus 301. That is, it was confirmed that lubricant G on photoconductor drum 320 was collected by developing sleeve 330.

What is claimed is:

1. An image forming apparatus comprising:

an image bearing member to which lubricant is supplied;

a toner image forming section configured to form a toner image on the image bearing member;

a patch image forming section configured to form a patch image different from the toner image on the image bearing member; and a control section configured to control the toner image forming section and the patch image forming section such that a first development condition for forming the patch image and a second development condition for forming the toner image are different from each other, wherein the control section sets the first development condition and the second development condition different from each other by operating such that a first potential difference between a first developing bias and a first surface potential of the image bearing member in formation of the patch image is smaller than a second potential difference between a second developing bias and a second surface potential of the image bearing member in formation of the toner image.

2. The image forming apparatus according to claim 1, wherein the patch image forming section forms the patch image with use of toner mixed with the lubricant to supply the lubricant onto the image bearing member.

3. The image forming apparatus according to claim 1 further comprising a lubricant application section configured to apply the lubricant onto the image bearing member to supply the lubricant onto the image bearing member.

4. The image forming apparatus according to claim 1, wherein the patch image forming section forms the patch image after the toner image is formed by the toner image forming section.

5. The image forming apparatus according to claim 1, wherein the patch image forming section forms the patch image before the toner image is formed by the toner image forming section.

6. The image forming apparatus according to claim 1, wherein the patch image forming section forms the patch image in a patch image formation region different from a toner image formation region in which the toner image is formed on the image bearing member.

7. The image forming apparatus according to claim 1, wherein, when an area ratio of the toner image is smaller than a predetermined area ratio, the patch image forming section forms the patch image.

8. The image forming apparatus according to claim 1, wherein the control section sets the first developing bias and the second developing bias different from each other such that the first potential difference is smaller than the second potential difference.

9. The image forming apparatus according to claim 1, wherein the control section sets the first surface potential and the second surface potential different from each other such that the first potential difference is smaller than the second potential difference.

10. The image forming apparatus according to claim 1, wherein the lubricant has a particle size smaller than a particle size of the toner.

11. An image forming system composed of a plurality of units including an image forming apparatus, the image forming system comprising:

an image bearing member to which lubricant is supplied;

a toner image forming section configured to form a toner image on the image bearing member;

a patch image forming section configured to form a patch image different from the toner image on the image bearing member; and a control section configured to control the toner image forming section and the patch image forming section such that a first development condition for forming the patch image and a second development condition for forming the toner image are different from each other, wherein the control section sets the first development condition and the second development condition different from each other by operating such that a first potential difference between a first developing bias and a first surface potential of the image bearing member in formation of the patch image is smaller than a second potential difference between a second developing bias and a second surface potential of the image bearing member in formation of the toner image.

12. The image forming system according to claim 11, wherein the patch image forming section forms the patch image with use of toner mixed with the lubricant to supply the lubricant onto the image bearing member.

13. The image forming system according to claim 11 further comprising a lubricant application section configured to apply the lubricant onto the image bearing member to supply the lubricant onto the image bearing member.

14. The image forming system according to claim 11, wherein the patch image forming section forms the patch image after the toner image is formed by the toner image forming section.

15. The image forming system according to claim 11, wherein the patch image forming section forms the patch image before the toner image is formed by the toner image forming section.

16. The image forming system according to claim 11, wherein the patch image forming section forms the patch image in a patch image formation region different from a toner image formation region in which the toner image is formed on the image bearing member.

17. The image forming system according to claim 11, wherein, when an area ratio of the toner image is smaller than a predetermined area ratio, the patch image forming section forms the patch image.

18. A controlling method in an image forming apparatus, the image forming apparatus comprising:

an image bearing member to which lubricant is supplied;

a toner image forming section configured to form a toner image on the image bearing member; and a patch image forming section configured to form a patch image different from the toner image on the image bearing member, wherein:

the toner image forming section and the patch image forming section are controlled such that a first development condition for forming the patch image and a second development condition for forming the toner image are different from each other, and the first development condition and the second development condition are set different from each other by operating such that a first potential difference between a first developing bias and a first surface potential of the image bearing member in formation of the patch image is smaller than a second potential difference between a second developing bias and a second surface potential of the image bearing member in formation of the toner image.

* * * * *